US008628079B2

(12) United States Patent
Herrmann et al.

(10) Patent No.: US 8,628,079 B2
(45) Date of Patent: Jan. 14, 2014

(54) METHOD AND DEVICE FOR FORMING AN AUXILIARY STACK

(71) Applicant: Heidelberger Druckmaschinen AG, Heidelberg (DE)

(72) Inventors: Bernd Herrmann, Malsch (DE); Rainer Klenk, St. Leon-Rot (DE); Uwe Peters, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/684,689

(22) Filed: Nov. 26, 2012

(65) Prior Publication Data

US 2013/0134668 A1 May 30, 2013

(30) Foreign Application Priority Data

Nov. 25, 2011 (DE) ..... 10 2011 119 422

(51) Int. Cl.
*B65H 31/12* (2006.01)

(52) U.S. Cl.
USPC ..... 271/218; 414/790.8

(58) Field of Classification Search
USPC ..... 271/218; 414/790.8
See application file for complete search history.

(56) References Cited

U.S. PATENT DOCUMENTS

| | | | | | |
|---|---|---|---|---|---|
| 5,125,639 | A * | 6/1992 | Henn | ..... | 271/189 |
| 5,322,272 | A * | 6/1994 | Benz et al. | ..... | 271/218 |
| 5,433,429 | A * | 7/1995 | Muller | ..... | 271/189 |
| 5,697,605 | A * | 12/1997 | Pollich et al. | ..... | 271/189 |
| 6,000,691 | A * | 12/1999 | Chmelar | ..... | 271/158 |
| 6,446,957 | B2 * | 9/2002 | Gunschera et al. | ..... | 271/218 |

FOREIGN PATENT DOCUMENTS

| | | | |
|---|---|---|---|
| DE | 3906649 | A1 | 10/1989 |
| DE | 4131015 | A1 | 4/1993 |
| DE | 102005058197 | A1 | 6/2007 |

* cited by examiner

*Primary Examiner* — David H Bollinger
(74) *Attorney, Agent, or Firm* — Laurence A. Greenberg; Werner H. Stemer; Ralph E. Locher

(57) ABSTRACT

A method for forming an auxiliary stack when a sheet stack is changed in a sheet delivery of a sheet-processing machine includes providing an auxiliary stack support for supporting the auxiliary stack during a non-stop stack change and multiple stop and separator elements disposed outside a stacking area in front of edges of the sheet stack to form a gap in a stream of sheets conveyed by a conveying system and released to fall onto the sheet stack. The sheet stack is lowered to form a gap for the auxiliary stack support, the stop elements for the front edge and the rear edge of the sheet stack are moved into a disengaged stand-by position before the main stack is lowered. For this purpose, the stop elements are equipped with remote-controllable actuating devices that are connected to a control unit. A device for forming an auxiliary stack is also provided.

9 Claims, 6 Drawing Sheets

METHOD AND DEVICE FOR FORMING AN AUXILIARY STACK

CROSS-REFERENCE TO RELATED APPLICATION

This application claims the priority, under 35 U.S.C. §119, of German Patent Application DE 10 2011 119 422.7, filed Nov. 25, 2011; the prior application is herewith incorporated by reference in its entirety.

BACKGROUND OF THE INVENTION

Field of the Invention

The present invention relates to a method and a device for forming an auxiliary stack when a sheet stack is changed in a delivery of a sheet-processing machine.

German Patent Application DE 10 2005 058 197 A1 discloses a method and a device as described above. At first, a sheet stack disposed between front-edge stops and rear-edge stops is lowered a specified distance to form a gap for receiving an auxiliary stack support. When the sheet stack has been lowered, sheet rests are moved into the stacking area from the rear as viewed in the direction of sheet travel and from the front as viewed in the direction of sheet travel to temporarily receive subsequent sheets. Then the auxiliary stack support is moved into the stacking region from the rear. In a final step the sheet rests are removed from the stacking area and the sheets that had temporarily been held are deposited on the auxiliary stack support.

The front-edge and rear-edge stops are engaged with the leading and trailing stack sides without any clearance to ensure that a straight stack is formed.

A disadvantage of that method is that when the sheet stack is lowered, the uppermost sheets may not be able to follow the lowering stack in a trouble-free way since they may get caught on the front and rear-edge stops.

SUMMARY OF THE INVENTION

It is accordingly an object of the invention to provide a method and a device for forming and automatically changing a stack, which overcome the hereinafore-mentioned disadvantages of the heretofore-known methods and devices of this general type and which ensure a reliable formation of a clearance for inserting an auxiliary stack support.

With the foregoing and other objects in view there is provided a method for forming an auxiliary stack when a sheet stack is changed in a sheet delivery of a sheet-processing machine including an auxiliary stack support for supporting the auxiliary stack during a non-stop stack change, multiple stop and separator elements disposed outside a stacking area in front of edges of the sheet stack to form a gap in a stream of sheets that are conveyed by a conveying system and released to fall onto the sheet stack and a sheet stack which is lowered to form a gap for the auxiliary stack support. According to the invention, immediately before the sheet stack is lowered, the stop elements are moved from an operating position at edges of the sheet stack into a stand-by position spaced apart from the edges of the sheet stack and after the sheet stack has been lowered by a distance, a sheet rest for the rear edge of the sheets is moved into the sheet stacking area.

With the objects of the invention in view, there is also provided a device for forming an auxiliary stack when a sheet stack is changed in a sheet delivery of a sheet-processing machine, comprising an auxiliary stack support for supporting the auxiliary stack during a non-stop stack change and multiple stop and separator elements disposed outside a stacking area in front of edges of the sheet stack to form a gap in a stream of sheets conveyed by a conveying system and released to fall onto the stack. According to the invention, actuating elements are provided to drive the stop elements, the sheet rests, the stack support and lifting elements.

A special advantage of the invention is that before the sheet stack is lowered to form a gap, the front and rear-edge stops, which are initially engaged with the sheet stack without clearance, are spaced apart from the sheet stack to enable the upper sheets to follow the stack without disruption.

In an advantageous further step of the method, the stops are returned into the position without clearance relative to the auxiliary sheet stack in order to ensure that a well-formed stack is created. This is preferably done before the sheet rests are removed from the stacking area.

In accordance with a particularly advantageous feature, all elements provided to carry out the method of the invention may be remote-controlled to allow a change of a sheet stack to be carried out in a fully automated way.

The invention may also be used in a sheet-fed die-cutting device.

Other features which are considered as characteristic for the invention are set forth in the appended claims.

Although the invention is illustrated and described herein as embodied in a method and a device for forming an auxiliary stack, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
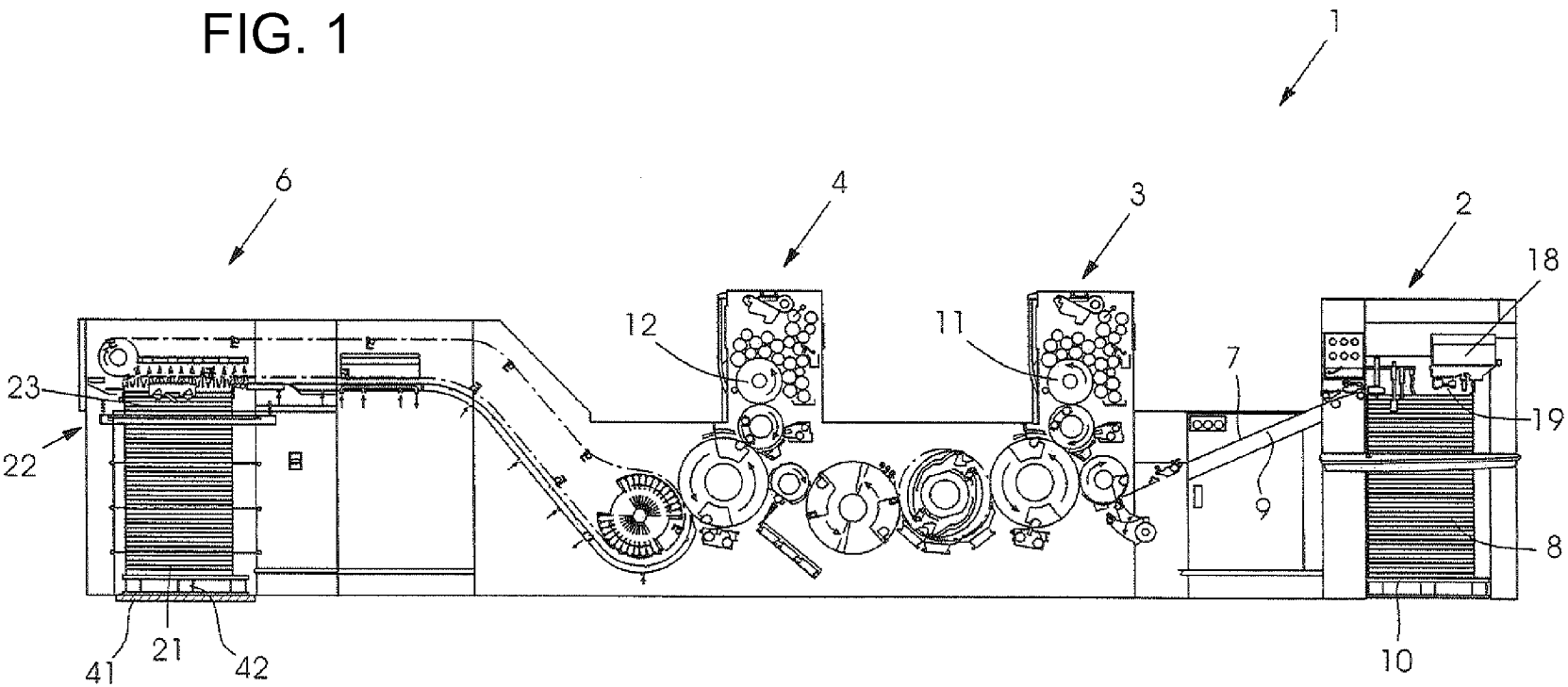
FIG. 1 is a diagrammatic, longitudinal-sectional view of a sheet-fed rotary printing press.

Referring now to the figures of the drawings in detail and first, particularly, to FIG. 1 thereof, there is seen a machine, for instance a printing press 1, for processing sheets 7. The printing press 1 includes a feeder 2, at least one printing unit 3, 4 and a delivery 6. The sheets 7 are removed from a stack 8 of sheets and are fed to the printing units 3, 4 either individually or in shingled formation over a feed table 9. As known in the art, each printing unit 3, 4 includes a plate cylinder 11, 12. Each plate cylinder 11, 12 is equipped with a device for mounting flexible printing plates. In addition, each plate cylinder 11, 12 is assigned a device for semi-automated or fully-automated printing plate changing.

The stack 8 of sheets rests on a main stack plate 10 that is liftable in a controlled way. The sheets 7 are removed from the top of the sheet stack 8 through the use of a so-called suction basket 18 which, among other components, includes a number of suction elements for separating lifting and dragging and thus separating the sheets 7. Blowers are provided to aerate the upper layers of sheets 7. The stack plate 10 can be lifted as required through the use of push buttons. A number of lateral and rear stops are provided to align the stack 8 of sheets 7, in particular the uppermost sheets 7 in the stack 8.

In order to carry out a non-stop stack change in the delivery 6, a main stack 21 may be removed from the delivery 6 while a new stack 23 is formed by an auxiliary stacking device 22.

Figure 2:
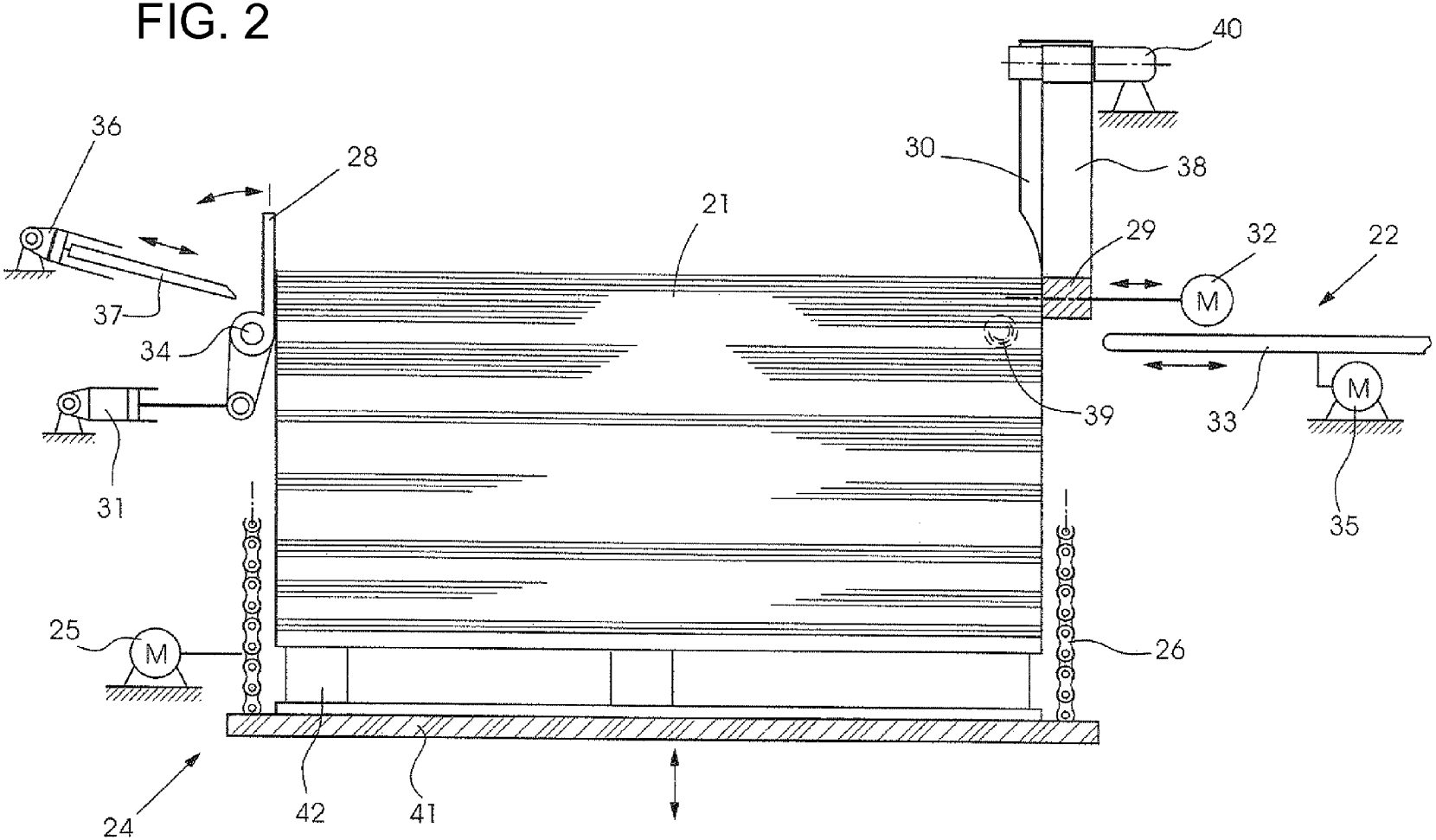
FIG. 2 is an enlarged, longitudinal-sectional view of a delivery of the sheet-fed rotary printing press.

As is seen in FIG. 2, a main stacking device 24 is suspended to be vertically movable on lifting chains 26 that are drivable by a lifting motor 25. The auxiliary stacking device 22 is likewise suspended to be vertically movable on (non-illustrated) drivable lifting chains.

A front-edge stop 28 and a rear-edge stop 29 are provided to form the main stack 21. As is shown in FIG. 2, these stops 28, 29 are respectively engaged with the front edge and the rear edge of the stack without clearance through the use of actuating devices 31, 32. The actuating device 31 is an actuator constructed as a pneumatic cylinder, for example. The actuating device 32 may be a driven shaft including a chain and a linear guide for the horizontal displacement of the rear-edge stop 29.

Figure 3:
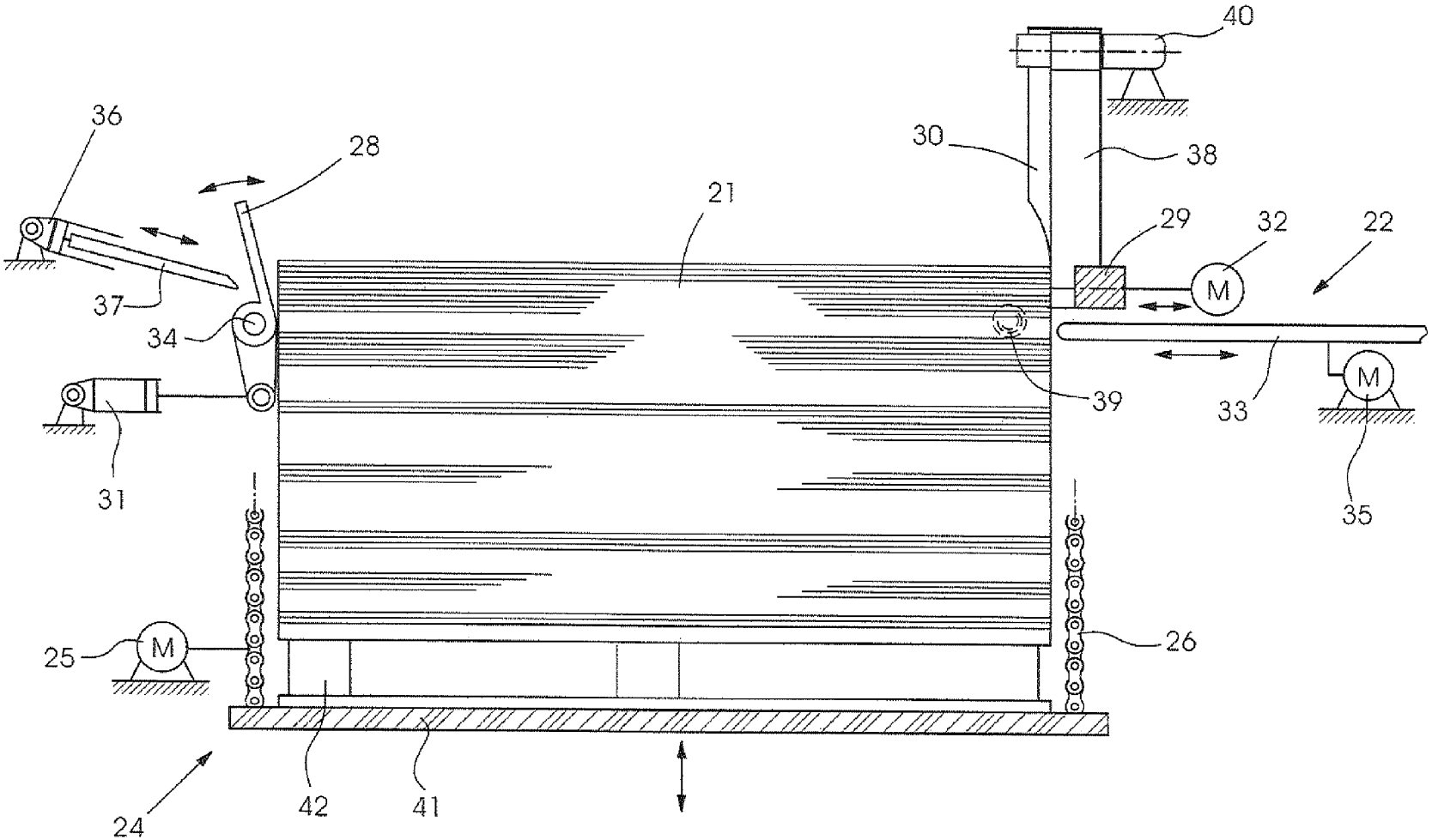
FIGS. 3-6 are longitudinal-sectional views of the delivery of the sheet-fed rotary printing press in different positions.

In order to move the main stack 21 out of the delivery 6 without disrupting the formation of the stack, sheets that are fed to the stacking region need to be intercepted by the auxiliary stacking device 22. For this purpose, an auxiliary stack support 33, which may be embodied like a plate, a grate, or a roller shutter, is moved into the stacking region. In order to be able to carry out this measure without disrupting the formation of the stack, the front edge and rear-edge stops 28, 29 are respectively removed from the front edge and the rear edge of the stack, through the use of the actuators 31, 32. In the preferred exemplary embodiment shown in FIG. 3, the front-edge stop 28 is pivoted away from the main stack 21 about a pivot axis 34 disposed on the level of the auxiliary stack support 33 on the auxiliary stacking device 22.

Figure 4:
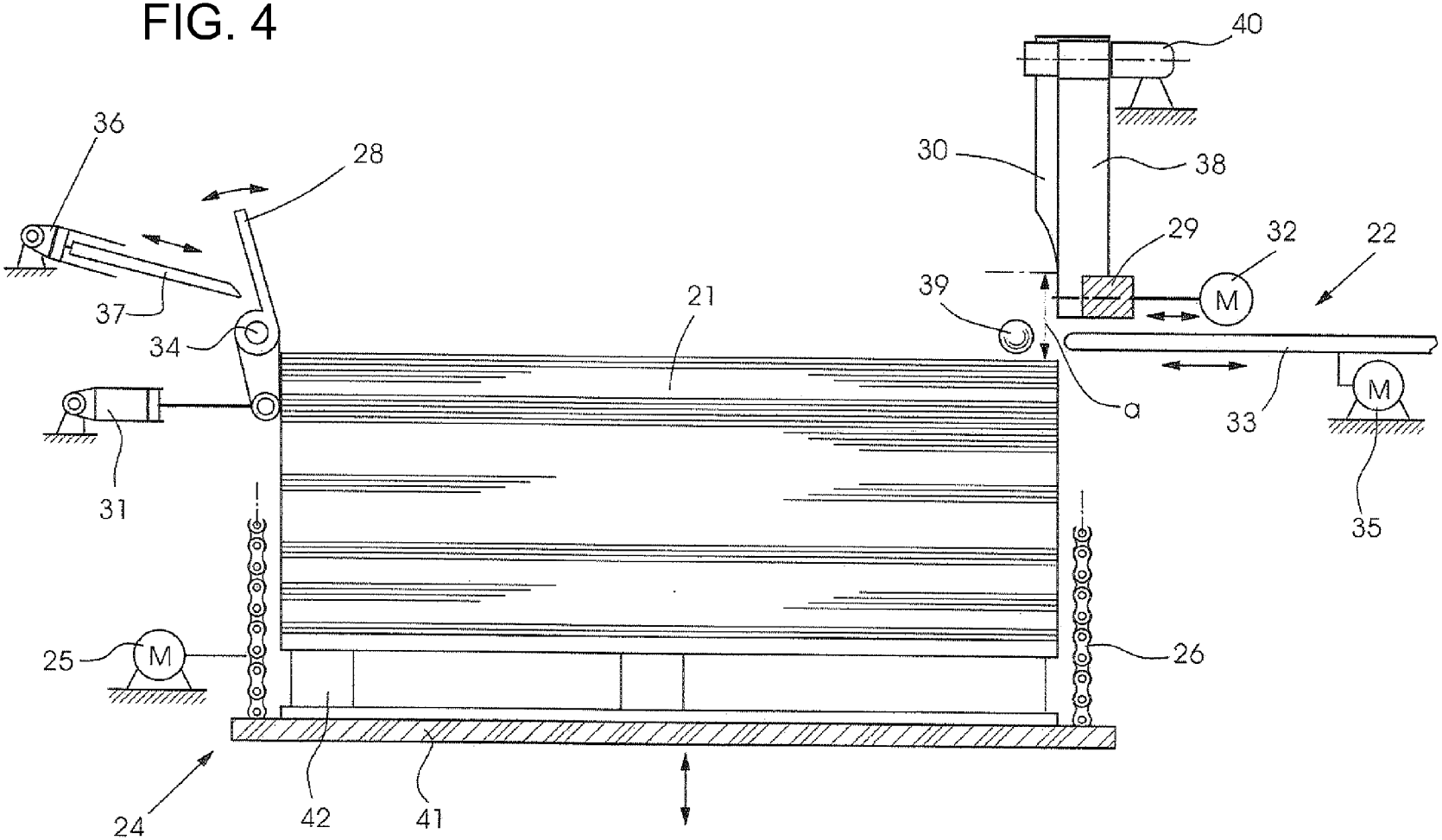

As is shown in FIG. 4, the main stack 21 is then lowered a first distance a to form a gap for the insertion of sheet rests 37, 38.

When a gap detection sensor 39 senses the presence of a gap, it causes the main stack 21 to stop in a lowered position and generates a signal to move the rear sheet rests 38 into the sheet stacking area. The sheet rest 38 for the rear edge of the sheets is embodied as a separator belt, which is preferably inserted into the stacking area in a direction perpendicular to the direction of sheet travel. An actuator 40 is provided to drive the separator belt.

Figure 5:
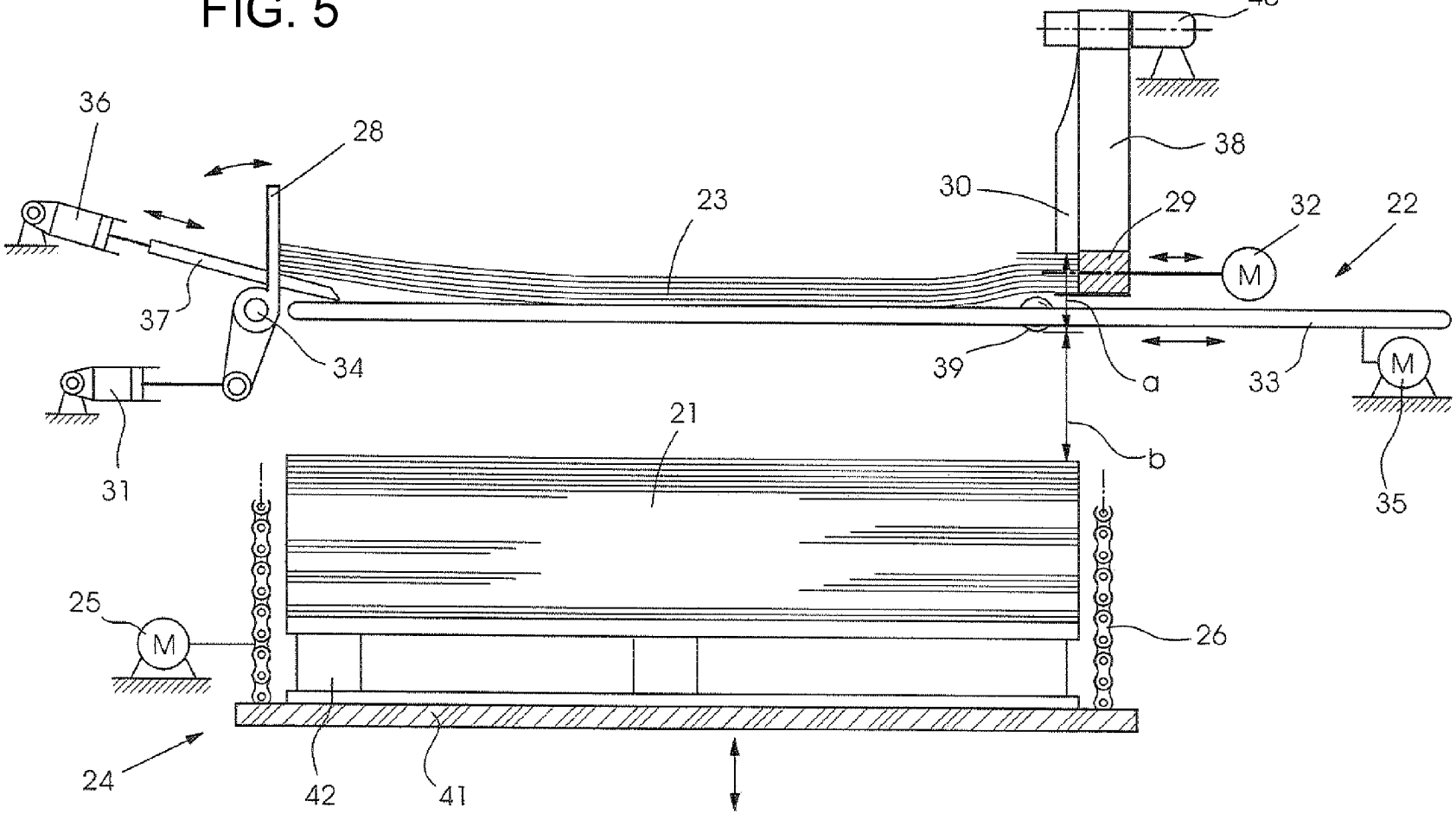

FIG. 5 shows that when the rear sheet rests 38 have been inserted, the front-edge and rear-edge stops 28, 29 are returned to their original positions adapted to the format length of the sheets to be processed.

In a subsequent step, the sheet rest 37 for the front edge of the sheets, which is formed of a number of fingers disposed to be perpendicular to the direction of sheet travel, is moved into the sheet stacking area. The fingers are disposed to be movable into two end positions through the use of a remote-controlled actuating device 36 such as an actuator in the form of a pneumatic cylinder.

In order to provide a larger gap for receiving the auxiliary stack support plate 33, the main stack 21 is lowered a further distance b in order to be able to move the auxiliary stack support 33 into the stacking area.

Actuating devices in the form of (non-illustrated) horizontally guided chains driven by an actuating motor 35 are provided to insert and remove the auxiliary stack support 33.

In a further step, the separator belt 38 for the rear edge of the sheets and the sheet rests 37 for the front edge of the sheets are retracted from the stacking area and returned to their stand-by positions.

Figure 6:
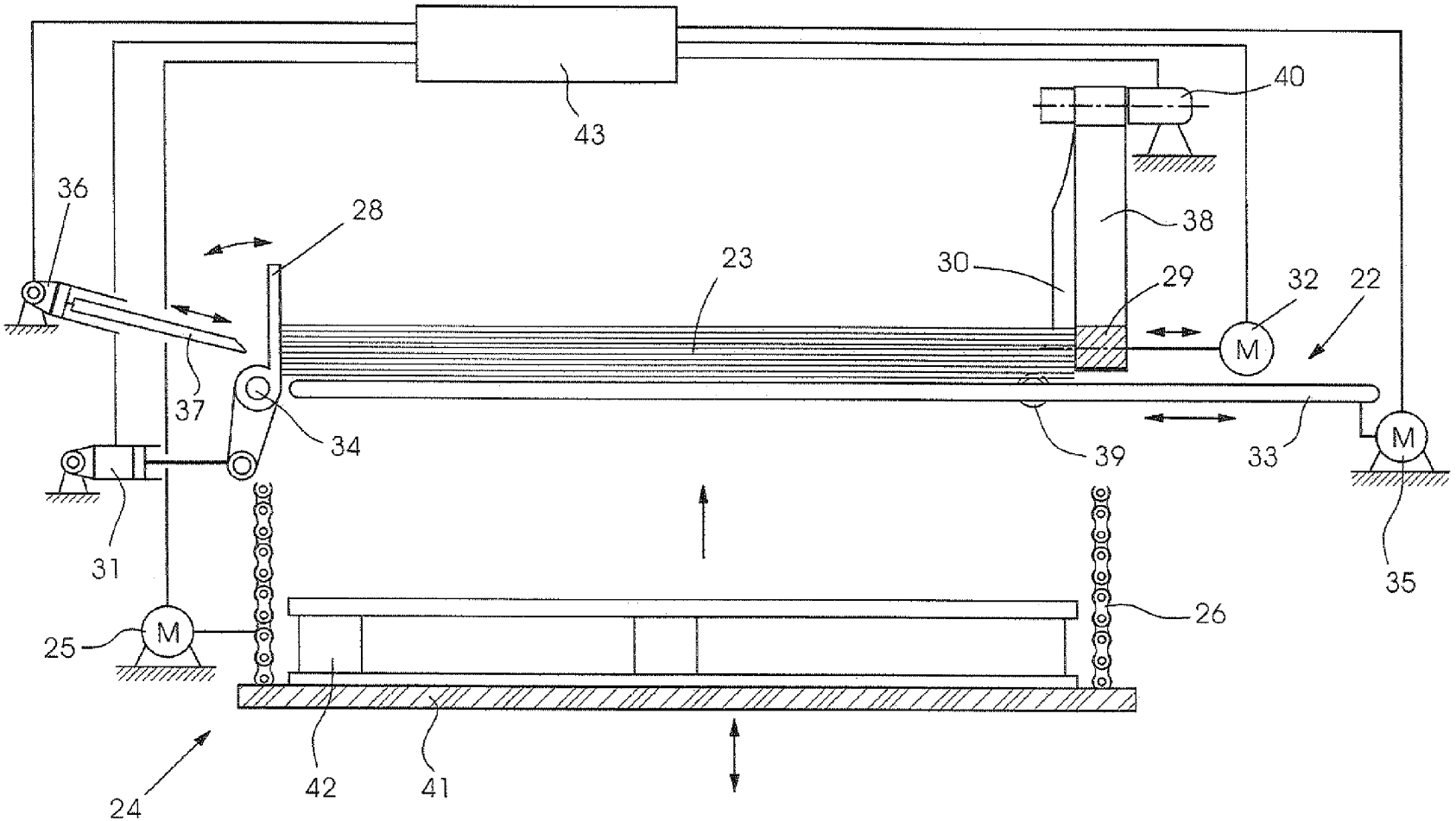

The main stack 21 may be removed from the delivery while the auxiliary stack 23 is formed on the auxiliary-stack support 33 as shown in FIG. 6, limited by the front-edge stop 28 and the rear-edge stop 29.

In order to deposit the auxiliary stack 23 on a stack plate 41 of the main stack 21, the lifting chains 26 lift the stack plate 41, or a pallet 42 disposed thereon, to a position immediately below the auxiliary stack support plate 33. As the auxiliary stack support plate 33 is moved out of the stacking area and into a stand-by position, the auxiliary stack 23 is deposited on the pallet 42 or on the stack support plate 41. The auxiliary stack 23 is now the new main stack 21.

All actuating motors and actuating devices contributing to the non-stop stack change are connected to a control unit 43 so that they may be remote-controlled and automatically actuated.

The invention claimed is:

1. A method for forming an auxiliary stack when changing a sheet stack in a sheet delivery of a sheet-processing machine, the method comprising the following steps:

supporting the auxiliary stack with an auxiliary stack support during a non-stop stack change;

conveying a stream of sheets with a conveying system and releasing the sheets to fall onto the sheet stack;

moving stop elements from an operating position in front of edges of the sheet stack into a stand-by position spaced apart from edges of the sheet stack and outside a stacking area immediately before lowering the sheet stack;

lowering the sheet stack by a distance to form a gap in the stream of sheets for the auxiliary-stack support; and moving a sheet rest separator element for rear edges of the sheets into the sheet stacking area after lowering the sheet stack.

2. The method according to claim 1, which further comprises returning the stop elements for the edges of the sheet stack to the operating position.

3. The method according to claim 2, which further comprises subsequently moving a sheet rest for the front edges of the sheets into the stacking area.

4. The method according to claim 3, which further comprises subsequently lowering the sheet stack again by a distance before moving the auxiliary stack support into the stacking area.

5. The method according to claim 1, which further comprises adjusting the auxiliary stack support, the stop elements, the sheet stack and the sheet rest separator element by remotely-controlled actuating elements controlled by a control unit.

6. A device for forming an auxiliary stack when changing a sheet stack in a sheet delivery of a sheet-processing machine, the device comprising:

an auxiliary stack support configured to support the auxiliary stack during a non-stop stack change;

a conveying system configured to convey a stream of sheets to be released to fall onto the sheet stack;

multiple stop and sheet rest separator elements disposed outside a stacking area in front of edges of the sheet stack and configured to form a gap in the stream of sheets;

lifting elements configured to lift the sheet stack; and actuating elements configured to drive said stop elements, said sheet rest separator elements, said auxiliary stack support and said lifting elements.

7. The device according to claim 6, which further comprises a control unit configured to actuate said actuating elements by remote control.

8. The device according to claim 6, wherein the sheet-processing machine is a sheet-fed die-cutting device or a sheet-fed rotary printing press.

9. The device according to claim 6, which further comprises:

a control unit, said control unit being programmed for:

supporting the auxiliary stack with said auxiliary stack support during a non-stop stack change;

conveying a stream of sheets with said conveying system and releasing the sheets to fall onto the sheet stack;

moving said stop elements from an operating position in front of edges of the sheet stack into a stand-by position spaced apart from edges of the sheet stack and outside a stacking area immediately before lowering the sheet stack;

lowering the sheet stack by a distance to form a gap in the stream of sheets for said auxiliary-stack support; and moving ones of said sheet rest separator elements for rear edges of the sheets into the sheet stacking area after lowering the sheet stack.

* * * * *